United States Patent [19]

Bender et al.

[11] Patent Number: 4,495,906

[45] Date of Patent: Jan. 29, 1985

[54] VALVE GUIDE ARRANGEMENT FOR THE VALVE STEM OF A VALVE IN AN INTERNAL COMBUSTION ENGINE

[75] Inventors: Franz Bender, Wendlingen; Gernot Hertweck, Fellbach; Michael Grohn, Esslingen; Peter Moser, Weinstadt, all of Fed. Rep. of Germany

[73] Assignee: Daimler-Benz AG, Fed. Rep. of Germany

[21] Appl. No.: 447,665

[22] Filed: Dec. 7, 1982

[30] Foreign Application Priority Data

Dec. 16, 1981 [DE] Fed. Rep. of Germany ..... 3149776

[51] Int. Cl.[3] ..... F01L 3/08

[52] U.S. Cl. ..... 123/188 GC; 123/41.85; 60/602

[58] Field of Search ..... 123/188 GC, 41.85, 41.76, 123/188 A; 60/602

[56] References Cited

U.S. PATENT DOCUMENTS

| | | | |
|---|---|---|---|
| 2,427,208 | 9/1947 | Haefeli | 123/41.85 |
| 3,104,520 | 9/1963 | Cazier et al. | 60/602 |
| 3,826,081 | 7/1974 | Van Avermaete | 123/41.85 |

FOREIGN PATENT DOCUMENTS

| | | | |
|---|---|---|---|
| 1042291 | 4/1954 | Fed. Rep. of Germany | 123/188 GC |
| 360382 | 4/1930 | United Kingdom | 123/653 A |

*Primary Examiner*—Ira S. Lazarus
*Assistant Examiner*—R. S. Bailey
*Attorney, Agent, or Firm*—Craig & Burns

[57] ABSTRACT

A valve guide arrangement for a valve in a bypass or shunt duct of exhaust gas ducting equipment of naturally induced or supercharged engines, in which arrangement the stem of the valve is caused to slide in a valve guide formed as a bush and fixed rigidly in a housing part and an annular space is provided under the valve guide and surrounding the valve stem and operating as a settling space, this annular space being connected with the bypass or shunt duct by means of an annular gap operating as a throttle and formed by the valve stem and the housing part.

The object of this special valve guide arrangement is to prevent valve jamming due to the solid exhaust-gas constituents found in the exhaust gas flow.

3 Claims, 2 Drawing Figures

Figure 1:
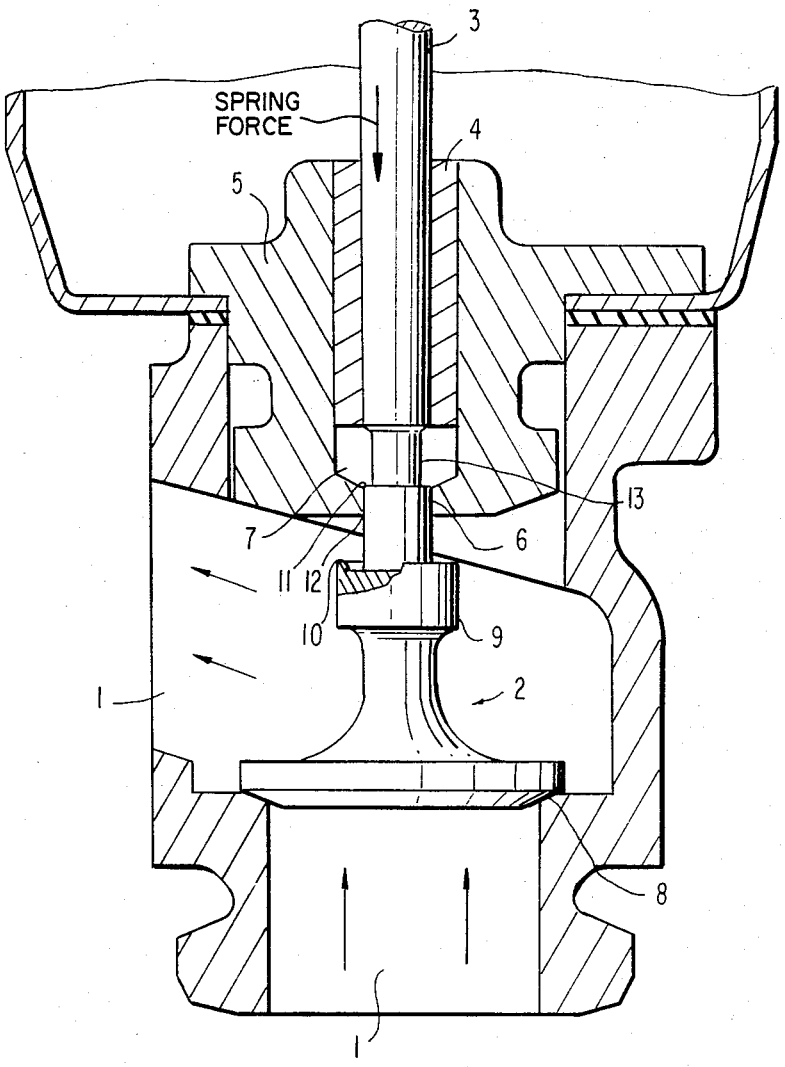

VALVE GUIDE ARRANGEMENT FOR THE VALVE STEM OF A VALVE IN AN INTERNAL COMBUSTION ENGINE

The invention relates to a valve guide arrangement for a valve controlling the exhaust gas flow of an internal combustion engine. The valve guide arrangement having a bush fixed rigidly in a housing part as the valve guide, under which an annular space is provided in the housing part and surrounding the valve stem of the valve and acting as a settling space, this annular space being connected with the exhaust gas flow by means of an annular gap formed by the housing part and the valve stem and acting as a throttle. A valve of this type is known from U.S. Pat. No. 2,427,208 which is, in fact, an exhaust valve located in the compression space and controlled by the cam shaft of the internal combustion engine in order to control the outlet procedure for the exhaust gases but which, however, provides a useful basis for blow down valves in supercharged engines.

Valves used as exhaust gas return valves in naturally induced and supercharged engines or as blow down valves in supercharged engines can, in contrast to such exhaust valves (U.S. Pat. No. 2,427,208) on which substantially higher driving forces operate, become inoperative due to so-called valve jamming in the valve guide. The result, on the one hand, would be a larger proportion of pollutants in the exhaust gas and, on the other hand, an impermissibly high boost pressure may be exceeded because there is no longer any bypass for the exhaust gases and thus an abnormally high rotational speed occurs in the turbine of the turbocharger.

The valve jamming occurs due to the penetration of solid exhaust gas constituents (soot particles) and rust particles between the valve guide and the valve stem. These particles which have penetrated form a deposit layer on both the valve stem and valve guide and this reduces the prescribed clearance to zero.

A valve guide for a valve of the type mentioned in the introduction is, in fact, known from DE-OS No. 2,951,811, in which sticking of the valve in the valve guide is to be prevented by appropriate cooling, but this arrangement does not guarantee lasting freedom from disturbance because deposit layers on the valve stem and the valve guide cannot be avoided.

The invention is directed to producing a valve guide arrangement, by simple design measures, in which no impairment of the disturbance-free operation of the valve occurs in either supercharged or naturally induced engines.

In order to achieve the object, a valve in the embodiment disclosed employed as a blow down valve opens automatically against a spring force in the flow direction and towards the valve guide and leads the exhaust gas flow to a bypass duct and, in addition, the annular gap formed by the housing part and the valve stem has a length corresponding to approximately half the diameter of the valve stem. The valve stem has a part which is reduced relative to the normal diameter of the stem, this part lying in the region of the settling space when the valve is closed. The length of the reduced part is such that it is not immersed completely in the valve guide when the valve is fully opened.

A valve guide arrangement according to the above described configuration may be characterized in that the valve stem of the valve has a collar limiting the valve lift, the outer edge of this collar being beaded in shaped and, when the valve is opened, contacting the housing part so as to make a seal.

Further, the invention described above may be characterized in that the housing part is formed with sharp edges at its upper and lower edges forming the limits of the annular gap and a compressed air duct connected with a compressed air source leads into the settling space.

The solid exhaust gas constituents penetrating into the annular gap are hardly in a position to settle within this annular gap because of length of the annular gap; only a proportion of them pass through the annular gap and finally arrive in the settling space. No valve jamming occurs with this valve guide arrangement. Furthermore, because of the position and shaping of the part of the valve stem, soot deposits on the bush and the area of the valve stem above this part of the stem are prevented.

An object of the invention is an improved valve guide arrangement for internal combustion engines.

A further object of the invention is an improved valve guide arrangement in which no impairment of the disturbance-free operation of the valve occurs in either supercharged or naturally induced engines.

Another object of the invention is a blow-down valve which opens automatically against a spring force in the flow direction and towards the valve guide and leads the exhaust gas flowed to a bypass duct and, in addition, the annular gap formed by the housing part and the valve stem has a length corresponding to approximately half the diameter of the valve stem, the valve stem having a part which is reduced relative to the normal diameter of the stem, this part lying in the region of the settling space when the valve is closed, the length of the reduced part being such that it is not immersed completely in the valve guide when the valve is fully opened.

Another object of the invention is a structure of the character set forth above wherein the valve stem of the valve has a collar limiting the valve lift, the outer edge of the collar being beaded in shape and, when the valve is opened, contacting the housing part so as to make a seal.

A still further object of the invention is a structure of the character set forth above wherein the housing part is formed with sharp edges at its upper and lower edges forming the limits of an annular gap.

Another object of the invention is a structure of the character set forth above wherein a compressed air duct is provided which is connected with a compressed air source and leading into a settling space.

Figure 2:
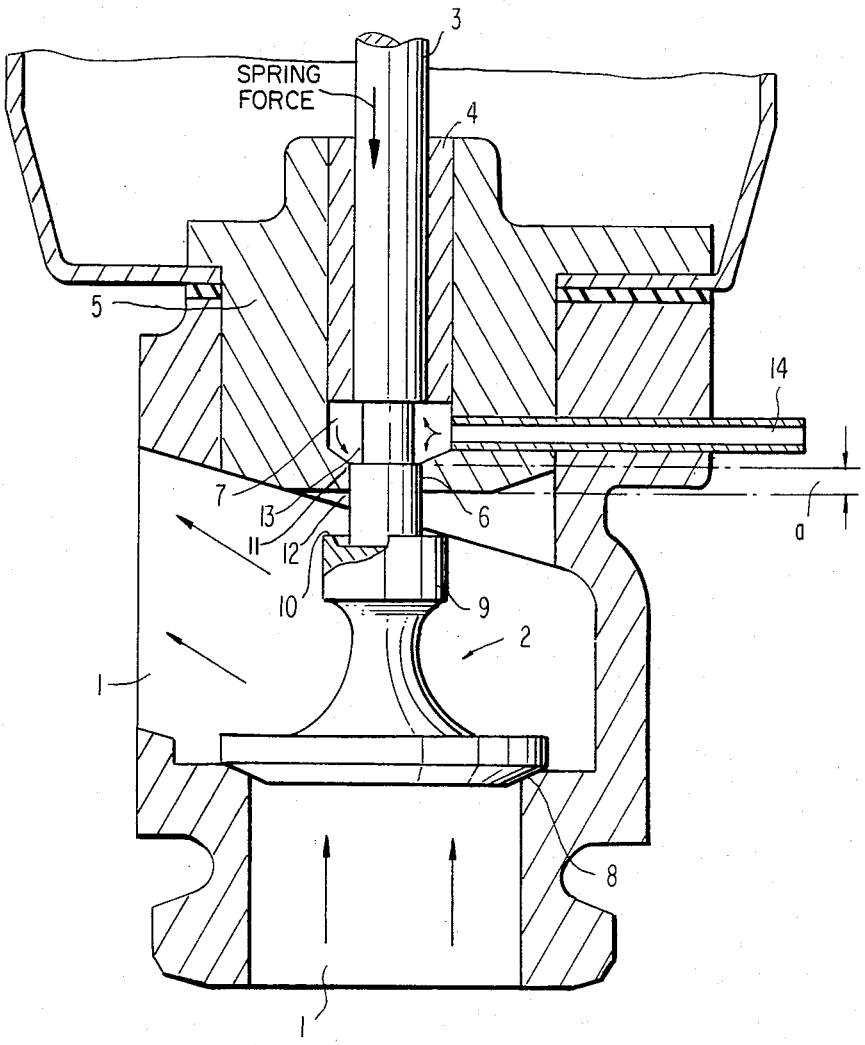

These and other objects, features, and advantages of the present invention will become more apparent from the following description when taken in connection with the accompanying drawings which show, for the purposes of illustration only, one embodiment in accordance with the present invention, and wherein:

FIG. 1 shows a section of a valve guide arrangement for the valve stem of a mushroom valve and FIG. 2 shows a section of the valve guide arrangement with a compressed air duct.

Turning to the drawings wherein like reference numerals represent like elements, in FIG. 1 an auxiliary duct 1 is provided in the exhaust gas ducting equipment of an internal combustion engine, branching off from the main exhaust gas pipe and operating as a bypass, and the exhaust gas flow is controllable by a mushroom valve 2 in this auxiliary duct. The valve stem 3 of this mushroom valve 2 is guided in a bush 4 acting as the valve guide and this bush is rigidly located in a housing part 5 of the exhaust gas ducting equipment. There is an annular gap 6 at the lower end of the housing part 5, which gap is formed by the valve stem 3 and the housing part 5. An annular space 7, which surrounds the valve stem 3, is provided between the annular gap 6 and the upper valve guide 4 formed by the bush, this annular space 7 acting as a settling space.

The mushroom valve 2 rises from its valve seat 8 in the flow direction and in the direction of the housing part 5 and contacts the housing part 5 by means of the collar 9 located on the valve stem and serving as a valve lift limiter. The upper outer edge 10 of the collar 9 is shaped as a bead and acts as both end stop and sealing surface. When the valve 2 is fully opened, this prevents the penetration of particles into the annular gap.

The length "a" of the annular gap 6 is so dimensioned that it corresponds to approximately half the diameter of the valve stem 3. The top and bottom edges 11 and 12 of the housing part 5, which limit the angular gap 6, have sharp edges in order to produce a certain scraping effect, during the lifting movement of the mushroom valve 2, on the soot particles stuck in the annular gap.

The valve stem 3 of the valve 2 is provided with a part 13 which is reduced relative to the normal diameter of the stem, this part 13 lying within the annular space 7 when the valve 2 is closed and being almost completely immersed in the bush 4 when the valve 2 is fully opened. Soot deposits on the bush and the valve stem are prevented by this means.

The annular gap dimension of the annular gap 6 is equal to or slightly greater than the guide or bearing clearance of the valve guide. The residual flow cross-section allows only a small exhaust gas flow through to pass through to the annular space 7.

The mode of operation of the valve guide arrangement may be improved by use of a sealing air supply. The embodiment shown in FIG. 2 is provided with a compressed air duct 14 leading into the annular space 7, this compressed air duct 14 being connected with a vehicle compressed air device, for example, braking equipment. The compressed air supply causes a pressure drop from the annular space 7 to the auxiliary duct 1 thus completely preventing the penetration of particles. Furthermore, the supply of air reduces the thermal loading on the valve guide arrangement.

The valve guide arrangement without the supply of compressed air, in accordance with FIG. 1, is mainly intended for naturally induced engines and that with compressed air supply, according to FIG. 2, is intended particularly for engines with supercharging or air compressing auxiliary drives, for example, compressed air pumps, of injection internal combustion engines.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A valve guide arrangement for a valve controlling the exhuast gas flow of an internal combustion engine, comprising a bush fixed rigidly in a housing part as a valve guide, an annular settling space between the valve guide and a valve head, the annular settling space disposed in a housing part and surrounding a valve stem of the valve, the annular settling space being connected with the exhaust gas flow by means of an annular throttling gap formed by the housing part and the valve stem, wherein the valve comprises a blow down valve means opening automatically in the flow direction against a spring force and towards the valve guide and leads the exhaust gas flow to a bypass duct, the annular throttling gap formed by the housing part and the valve stem has a length corresponding to approximately half the diameter of the valve stem, and the valve stem comprises a part which is reduced relative to the normal diameter of the stem, this part lying in the region of the annular settling space when the valve is closed, the length of the reduced part is such that it is not immersed completely into the valve guide when the valve is fully opened.

2. A valve guide arrangement according to claim 1, wherein the valve stem of the valve comprises a collar limiting the valve lift, the outer edge of the collar comprising beaded shape means for sealingly contacting the housing part when the valve is opened.

3. A valve guide arrangement according to claim 1, wherein the housing part further comprises sharp edges at its upper and lower edges forming the limits of the annular throttling gap.

* * * * *